US011417279B2

(12) United States Patent
Chen

(10) Patent No.: US 11,417,279 B2
(45) Date of Patent: Aug. 16, 2022

(54) PIXEL STRUCTURE AND DRIVING METHOD THEREOF, AND DISPLAY DEVICE

(71) Applicant: SHENZHEN CHINA STAR OPTOELECTRONICS SEMICONDUCTOR DISPLAY TECHNOLOGY CO., LTD., Guangdong (CN)

(72) Inventor: Jinxiang Chen, Shenzhen (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 231 days.

(21) Appl. No.: 16/764,626

(22) PCT Filed: Apr. 21, 2020

(86) PCT No.: PCT/CN2020/085947
§ 371 (c)(1),
(2) Date: May 15, 2020

(87) PCT Pub. No.: WO2021/203478
PCT Pub. Date: Oct. 14, 2021

(65) Prior Publication Data

US 2022/0114971 A1 Apr. 14, 2022

(30) Foreign Application Priority Data

Apr. 8, 2020 (CN) ..... 202010270600.5

(51) Int. Cl.
*G09G 3/3275* (2016.01)

(52) U.S. Cl.
CPC ... *G09G 3/3275* (2013.01); *G09G 2300/0876* (2013.01); *G09G 2320/0233* (2013.01)

(58) Field of Classification Search
CPC .. G09G 3/3275; G09G 3/3225; G09G 3/3258; G09G 3/3233; G09G 3/3266;
(Continued)

(56) References Cited

U.S. PATENT DOCUMENTS 10,056,034 B2 8/2018 Zhu et al.
10,593,260 B1 3/2020 Cai
(Continued)

FOREIGN PATENT DOCUMENTS

CN 101847363 A 9/2010
CN 104680982 A 6/2015
(Continued)

*Primary Examiner* — Nitin Patel
*Assistant Examiner* — Amen W Bogale
(74) *Attorney, Agent, or Firm* — Benesch, Friedlander, Coplan & Aronoff LLP

(57) ABSTRACT

The present invention provides a pixel structure and a driving method thereof, and a display device. The pixel structure includes a switch unit, a driving unit, a plurality of thin film transistors, and at least one capacitor. In a driving process, control signals are provided by a same global control signal for realizing simultaneous control of the plurality of thin film transistors within a frame of time, thereby achieving synchronous light emission of a pixel structure circuit, and improving consistency and display quality of display images of larger-size display panels.

13 Claims, 3 Drawing Sheets

(58) Field of Classification Search
CPC ..... G09G 3/3291; G09G 3/3648; G09G 2300/0426; G09G 2300/0861; G09G 2300/0809; G09G 2300/0819; G09G 2300/0852; G09G 2300/0439; G09G 2300/0842; G09G 2300/0876; G09G 2300/043; G09G 2310/0264; G09G 2310/061; G09G 2310/0262; G09G 2320/043; G09G 2320/02; G09G 2320/045; G09G 2320/0233; G09G 2320/0219; G09G 2320/0626; G09G 2320/0238; H01L 27/3265; H01L 27/3276; H01L 27/3262
See application file for complete search history.

(56) References Cited

U.S. PATENT DOCUMENTS

2009/0009441 A1* 1/2009 Yamamoto ..... G09G 3/3233 345/80
2010/0245402 A1 9/2010 Choi et al.
2015/0161940 A1* 6/2015 Woo ..... G09G 3/3241 345/58
2017/0039941 A1* 2/2017 Wu ..... G09G 3/32
2017/0236470 A1* 8/2017 Miki ..... G09G 3/3258 345/690
2017/0256205 A1* 9/2017 Zhu ..... G09G 3/3233
2017/0278457 A1* 9/2017 Zhu ..... G09G 3/3233
2017/0294163 A1 10/2017 Wu et al.
2018/0102090 A1 4/2018 Han

FOREIGN PATENT DOCUMENTS

CN 105679243 A 6/2016
CN 105845085 A 8/2016
CN 107492343 A 12/2017
CN 106710528 B 3/2019
KR 20070118857 A 12/2007
KR 20130057595 A 6/2013

* cited by examiner

PIXEL STRUCTURE AND DRIVING METHOD THEREOF, AND DISPLAY DEVICE

FIELD OF INVENTION

The present disclosure relates to the field of display technology, and more particularly, to a pixel structure and a driving method thereof, and a display device.

BACKGROUND OF INVENTION

Organic light-emitting diodes (OLEDs), as a light-emitting device, have been widely applied in various display devices.

OLEDs can be divided into passive matrix drive and active matrix drive according to a driving method. For the active matrix driving method, panels have self-illumination, high brightness, color saturation, and responsiveness in current display field, but their service lifespan has become a bottleneck for its further development. Meanwhile, for current display panels, most low-temperature polysilicon substrates are used. When a thin film transistor array is manufactured on a low-temperature polysilicon substrate, a threshold voltage (Vth) value of thin film transistors on the substrate is not uniform due to manufacturing processes and other reasons. As a result, a difference in a driving circuit generated by each thin film transistor occurs during driving or operation, resulting in inconsistency in brightness emitted by each light-emitting diode, which ultimately leads to poor display effect of display panels. Especially for larger-size OLED display panels, the impact is more significant.

Therefore, solutions are necessary be provided to solve the problems in the prior art.

SUMMARY OF INVENTION

In summary, in current light-emitting diode display devices, when manufacturing a thin film transistor array, a threshold voltage of thin film transistors is not uniform during driving or operation, and a greater difference occurs in a driving circuit, resulting in inconsistency in brightness emitted by light-emitting diodes and poor display effect.

In order to solve the above problem, the present disclosure provides a pixel structure and a driving method thereof, and a display device, to solve the problems that a threshold voltage of each thin film transistor is not uniform in a pixel circuit structure, brightness emitted by light-emitting diodes is inconsistent, and display effect and device stability are poor.

In order to solve the above technical problems, technical solutions provided by embodiments of the present disclosure are as follows.

According to a first aspect of an embodiment of the present disclosure providing a pixel structure. The pixel structure is electrically connected to a data line, a first voltage line, and a second voltage line. The pixel structure comprises a switch unit, wherein the switch unit comprises a control end, a first end, and a second end, and the first end of the switch unit is electrically connected to the first voltage line; a first thin film transistor, wherein a drain of the first thin film transistor is electrically connected to the second voltage line; a second thin film transistor, wherein a drain of the second thin film transistor is electrically connected to the second end, and a gate of the second thin film transistor is electrically connected to a source of the first thin film transistor, a third thin film transistor, wherein a source of the third thin film transistor is electrically connected to a source of the second thin film transistor; a first capacitor, wherein one end of the first capacitor is connected to the source of the first thin film transistor and the gate of the second thin film transistor, and the other end of the first capacitor is connected to the source of the second thin film transistor; alight-emitting diode, wherein an end of the light-emitting diode is electrically connected to the other end of the capacitor, and the other end of the light-emitting diode is grounded; a driving unit, wherein the driving unit comprises a control end, a first end, and a second end, the first end of the driving unit is electrically connected to the data line, and the second end of the driving unit is electrically connected to the gate of the second thin film transistor, wherein the driving unit comprises a fourth thin film transistor, the first end of the driving unit is a drain of the fourth thin film transistor, the second end of the driving unit is a source of the fourth thin film transistor, and the control end of the driving unit is a gate of the fourth thin film transistor; the control end of the driving unit is electrically connected to a scanning signal line to receive a scanning signal, the control end of the switch unit, the gate of the first thin film transistor, and the gate of the third thin film transistor are connected to corresponding gate signal lines for realizing simultaneous control and synchronized light emitting within a frame of time; and a fifth thin film transistor, wherein a drain of the fifth thin film transistor is connected to the second end of the driving unit, and a source of the fifth thin film transistor is electrically connected to the source of the first thin film transistor, the gate of the second thin film transistor, and the end of the first capacitor.

According to one embodiment of the present disclosure, the pixel structure further comprises a second capacitor, and one end of the second capacitor is electrically connected to the second end of the driving unit, and the other end of the second capacitor is grounded.

According to one embodiment of the present disclosure, agate of the fifth thin film transistor is connected to a corresponding gate signal line.

According to one embodiment of the present disclosure, the switch unit comprises a thin film transistor, the first end of the switch unit is a drain of the thin film transistor, the second end of the switch unit is a source of the thin film transistor, and the control end of the switch unit is a gate of the thin film transistor.

According to one embodiment of the present disclosure, the thin film transistor is a true color thin film transistor.

According to one embodiment of the present disclosure, the pixel structure further comprises a global input signal, the global input signal provides a control signal for the control end of the switch unit, the gate of the first thin film transistor, and the gate of the third thin film transistor.

According to one embodiment of the present disclosure, a capacitance of the first capacitor is equal to a capacitance of the second capacitor, and the second capacitor is configured to store a data signal written by the driving unit.

According to a second aspect of the embodiment of the present disclosure proving a pixel structure. The pixel structure is electrically connected to a data line, a first voltage line, and a second voltage line, and the pixel structure comprises a switch unit, wherein the switch unit comprises a control end, a first end, and a second end, and the first end of the switch unit is electrically connected to the first voltage line; a first thin film transistor, wherein a drain of the first thin film transistor is electrically connected to the second voltage line; a second thin film transistor, wherein a drain of the second thin film transistor is electrically connected to the second end, and a gate of the second thin film transistor is electrically connected to a source of the first thin film transistor; a third thin film transistor, wherein a source of the third thin film transistor is electrically connected to a source of the second thin film transistor; a first capacitor, wherein one end of the first capacitor is connected to the source of the first thin film transistor and the gate of the second thin film transistor, and the other end of the first capacitor is connected to the source of the second thin film transistor; alight-emitting diode, wherein an end of the light-emitting diode is electrically connected to the other end of the capacitor, and the other end of the light-emitting diode is grounded; and a driving unit, wherein the driving unit comprises a control end, a first end, and a second end, the first end of the driving unit is electrically connected to the data line, and the second end of the driving unit is electrically connected to the gate of the second thin film transistor, wherein the control end of the driving unit is electrically connected to a scanning signal line to receive a scanning signal, and the control end of the switch unit, the gate of the first thin film transistor, and the gate of the third thin film transistor are connected to corresponding gate signal lines for realizing simultaneous control and synchronized light emitting within a frame of time.

According to one embodiment of the present disclosure, the pixel structure further comprises a second capacitor and a fifth thin film transistor, one end of the second capacitor is electrically connected to the second end of the driving unit, and the other end of the second capacitor is grounded, and a drain of the fifth thin film transistor is connected to the second end of the driving unit, and a source of the fifth thin film transistor is electrically connected to the source of the first thin film transistor, the gate of the second thin film transistor, and the end of the first capacitor.

According to one embodiment of the present disclosure, agate of the fifth thin film transistor is connected to a corresponding gate signal line.

According to one embodiment of the present disclosure, wherein the driving unit comprises a fourth thin film transistor, the first end of the driving unit is a drain of the fourth thin film transistor, the second end of the driving unit is a source of the fourth thin film transistor, and the control end of the driving unit is a gate of the fourth thin film transistor.

According to one embodiment of the present disclosure, the switch unit comprises a thin film transistor, the first end of the switch unit is a drain of the thin film transistor, the second end of the switch unit is a source of the thin film transistor, and the control end of the switch unit is a gate of the thin film transistor.

According to one embodiment of the present disclosure, the thin film transistor is a true color thin film transistor.

According to one embodiment of the present disclosure, the pixel structure further comprises a global input signal, the global input signal provides a control signal for the control end of the switch unit, the gate of the first thin film transistor, and the gate of the third thin film transistor.

According to one embodiment of the present disclosure, a capacitance of the first capacitor is equal to a capacitance of the second capacitor, and the second capacitor is configured to store a data signal written by the driving unit.

According to a third aspect of the present disclosure proving a display device. The display device comprises the pixel structure in the embodiment of the present disclosure. The display device comprises a pixel structure, the pixel structure is electrically connected to a data line, a first voltage line, and a second voltage line, and the pixel structure comprises a switch unit, wherein the switch unit comprises a control end, a first end, and a second end, and the first end of the switch unit is electrically connected to the first voltage line; a first thin film transistor, wherein a drain of the first thin film transistor is electrically connected to the second voltage line; a second thin film transistor, wherein a drain of the second thin film transistor is electrically connected to the second end, and a gate of the second thin film transistor is electrically connected to a source of the first thin film transistor; a third thin film transistor, wherein a source of the third thin film transistor is electrically connected to a source of the second thin film transistor; a first capacitor, wherein one end of the first capacitor is connected to the source of the first thin film transistor and the gate of the second thin film transistor, and the other end of the first capacitor is connected to the source of the second thin film transistor; a light-emitting diode, wherein an end of the light-emitting diode is electrically connected to the other end of the capacitor, and the other end of the light-emitting diode is grounded; and a driving unit, wherein the driving unit comprises a control end, a first end, and a second end, the first end of the driving unit is electrically connected to the data line, and the second end of the driving unit is electrically connected to the gate of the second thin film transistor, wherein the control end of the driving unit is electrically connected to a scanning signal line to receive a scanning signal, and the control end of the switch unit, the gate of the first thin film transistor, and the gate of the third thin film transistor are connected to corresponding gate signal lines for realizing simultaneous control and synchronized light emitting within a frame of time.

According to one embodiment of the present disclosure, the pixel structure further comprises a second capacitor and a fifth thin film transistor, one end of the second capacitor is electrically connected to the second end of the driving unit, and the other end of the second capacitor is grounded, and a drain of the fifth thin film transistor is connected to the second end of the driving unit, and a source of the fifth thin film transistor is electrically connected to the source of the first thin film transistor, the gate of the second thin film transistor, and the end of the first capacitor.

According to one embodiment of the present disclosure, wherein the driving unit comprises a fourth thin film transistor, the first end of the driving unit is a drain of the fourth thin film transistor, the second end of the driving unit is a source of the fourth thin film transistor, and the control end of the driving unit is a gate of the fourth thin film transistor.

According to one embodiment of the present disclosure, a capacitance of the first capacitor is equal to a capacitance of the second capacitor, and the second capacitor is configured to store a data signal written by the driving unit.

According to one embodiment of the present disclosure, the switch unit comprises a thin film transistor, the first end of the switch unit is a drain of the thin film transistor, the second end of the switch unit is a source of the thin film transistor, and the control end of the switch unit is a gate of the thin film transistor.

In summary, beneficial effects of the embodiments of the present disclosure are that the embodiment of present disclosure provides the pixel structure and the driving method thereof, and the display device. A global control signal is input to enable the fifth thin film transistor, the first thin film transistor, and the third thin film transistor to be turned on or off at the same time within a frame of time, resulting in consistency of a threshold voltage of the thin film transistor in the pixel structure, which effectively improves uniformity of light emission of devices in display devices, especially larger-size display devices, reduces screen flash problem of display panels, and improves display effect of display devices.

DETAILED DESCRIPTION OF PREFERRED EMBODIMENTS

The descriptions of following embodiments refer to attached drawings to illustrate specific embodiments that can be implemented by the present disclosure.

Figure 1:
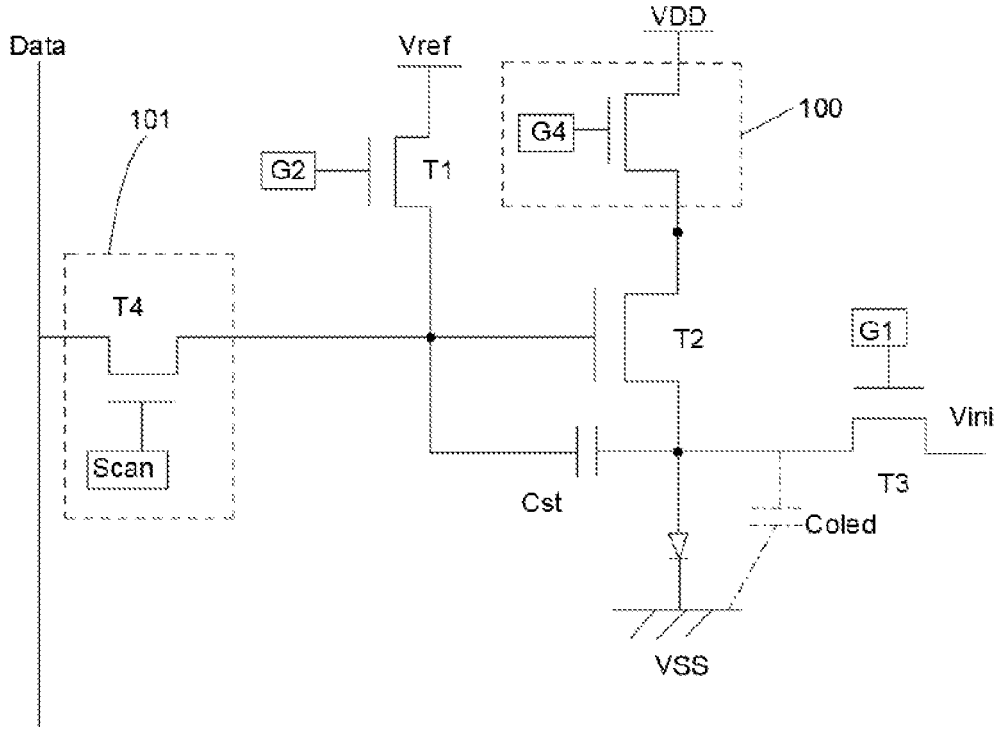
FIG. 1 is a circuit diagram of a pixel structure in an embodiment of the present disclosure.

An embodiment of the present disclosure provides a pixel structure. As shown in FIG. 1, FIG. 1 is a circuit diagram of a pixel structure in an embodiment of the present disclosure. The pixel structure comprises a switch unit 100 and a driving unit 101. Specifically, the switch unit 100 further comprises a control end, a first end, and a second end, and the driving unit 101 also comprises a control end, a first end, and a second end of the driving unit 101.

Specifically, the first end of the switch unit 100 is electrically connected to a first voltage line VDD, and the second end of the switch unit 100 is electrically connected to a drain of a second thin film transistor T2.

The first end of the driving unit 101 is electrically connected to a data line Data. Meanwhile, the second end of the driving unit 101 is connected to a gate of the second thin film transistor, and electrically connected to a source of a first thin film transistor T1 and one end of a first capacitor Cst at the same time.

The switch unit 100 and the driving unit 101 may comprise thin film transistors. In the embodiment of the present disclosure, the switching unit 100 uses a thin film transistor, and the driving unit 101 uses a fourth thin film transistor T4 as an example for description.

Specifically, the switch unit 100 is a thin film transistor, the first end of the switch unit 100 is a drain of the thin film transistor, the second end of the switch unit 100 is a source of the thin film transistor, the control end of the switch unit 100 is a gate of the thin film transistor, and the two correspond to each other in connection. Meanwhile, the gate of the thin film transistor is connected to a gate signal control line G4 to provide a gate driving signal.

Specifically, the driving unit 101 is a fourth thin film transistor T4, the first end of the driving unit is a drain of the fourth thin film transistor T4, the second end of the driving unit is a source of the fourth thin film transistor T4, and the control end of the driving unit is a gate of the fourth thin film transistor T4. Meanwhile, the gate of the fourth thin film transistor T4 is connected to the scan signal line Scan to provide a scan signal. In the embodiment of the present disclosure, the scan signal line adopts a progressive scanning mode to turn on the corresponding fourth thin film transistor.

Furthermore, the pixel structure further comprises the second thin film transistor T2, and the second thin film transistor T2 is a driving thin film transistor, wherein a source of the second thin film transistor T2 is connected to one end of a light-emitting diode. Meanwhile, the other end of the first capacitor is electrically connected to a source of a third thin film transistor T3, and a drain of the second thin film transistor T2 is electrically connected to the source of the thin film transistor in switch unit 100.

For the light-emitting diode, one end of the light-emitting diode is connected the source of the second thin film transistor T2, the other end of the first capacitor Cst, and the source of the third thin film transistor T3, and the other end of the light-emitting diode is grounded.

For the first thin film transistor T1, a drain of the first thin film transistor T1 is electrically connected to a second voltage line Vref, and the source of the first thin film transistor T1 is electrically connected to the second end of the driving unit 101. Meanwhile, the source of the first thin film transistor T1 is connected to one end of the first capacitor Cst and the gate of the second thin film transistor T2. Furthermore, the gate of the first thin film transistor is also connected to a gate signal control line G2 corresponding thereof to provide a gate control signal for thereof.

For the third thin film transistor T3, a drain of the third thin film transistor T3 is connected to an initial signal line Vini, the source of the third thin film transistor T3 is connected to one end of the light-emitting diode, and simultaneously connected to the other end of the first capacitor Cst and the source of the second thin film transistor T2. Furthermore, the gate of the third thin film transistor T3 is connected to a gate signal control line G1 corresponding thereof to provide a gate control signal for the third thin film transistor T3.

In the embodiment of the present disclosure, the gate of the thin film transistor, the gate of the first thin film transistor T1, and the gate of the third thin film transistor T3 corresponding to the control end of the switch unit 100 are connected to the gate signal control line G4, the gate signal control line G2, and the gate signal control line G1 corresponding thereof. For a purpose of synchronous control, in the embodiment of the present disclosure, a global signal provides the gate control signals to the gate signal control line G1 and the gate signal control line G2, thereby achieving the purpose of synchronous control within a same frame time, and finally reducing a difference of threshold Vth of each thin film transistor, and improving display effect.

In a driving control process, the first capacitor Cst is configured to store direct voltage Vgs of the gate and the source of the second thin film transistor T2 to ensure that a driving circuit works normally.

In the embodiment of the present disclosure, the thin film transistor corresponding to the switch unit 100 is a true color thin film transistor, which improve display effect of display panels and display devices.

Figure 2:
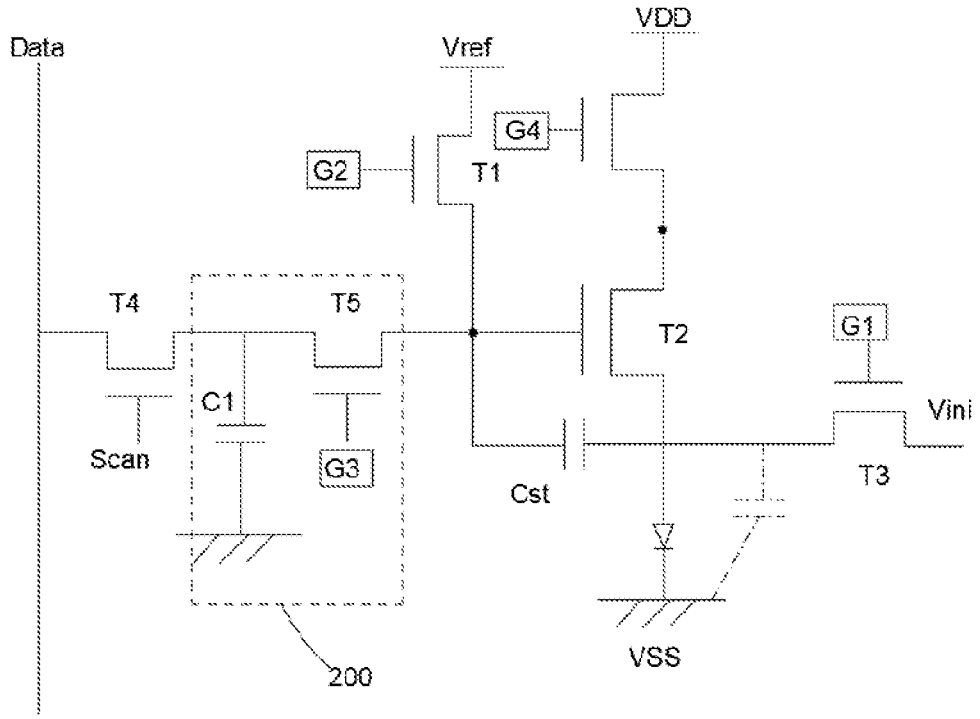
FIG. 2 is another circuit diagram of the pixel structure in the embodiment of the present disclosure.

Preferably, as shown in FIG. 2, FIG. 2 is another circuit diagram of the pixel structure in the embodiment of the present disclosure. Simultaneously combined with the schematic circuit diagram of the pixel structure in FIG. 1, the pixel structure further comprises a second unit 200. Specifically, the second unit 200 comprises a fifth thin film transistor T5 and a second capacitor C1. One end of the second capacitor C1 is electrically connected to the source of the fourth thin film transistor T4, and the other end of the second capacitor is grounded.

Meanwhile, a drain of the fifth thin film transistor T5 is connected to the source of the fourth thin film transistor T4, and simultaneously connected to one end of the second capacitor C1. Moreover, a source of the fifth thin film transistor T5 is electrically connected to the source of the first thin film transistor T1, the gate of the second thin film transistor T2, and one end of the first capacitor Cst, wherein a capacitance of the first capacitor Cst may be equal to a capacitance of the second capacitor C1.

Furthermore, a gate of the fifth thin film transistor T5 is connected to corresponding gate signal control line G3, and the gate signal control line G3 provides a gate signal for thereof.

In the embodiment of the present disclosure, the global signal provides drive signals for the gate signal control line G1, the gate signal control line G2, and the gate signal control line G3 simultaneously within a frame, so that the corresponding thin film transistors are turned on or turned off, and synchronous light emission is finally achieved, reducing a problem that threshold drift of the thin film transistors in the pixel structure circuit is large and consistency of the light emission display is poor.

Figure 3:
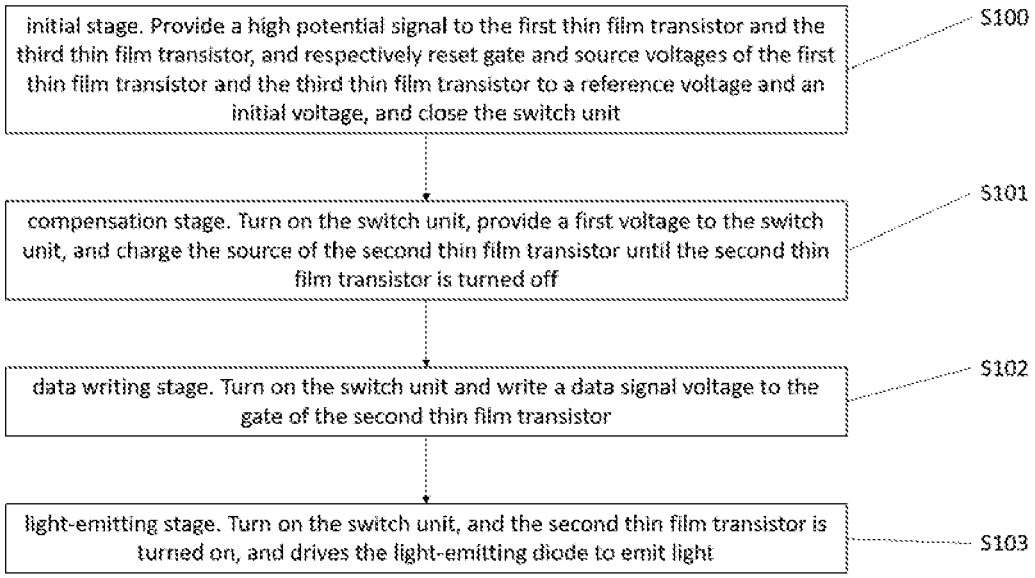
FIG. 3 is a schematic flowchart of a driving method of the pixel structure in the embodiment of the present disclosure.

Preferably, as shown in FIG. 3, FIG. 3 is a schematic flowchart of a driving method of the pixel structure in the embodiment of the present disclosure. Specifically, a driving step comprises steps as follows:

S100: initial stage. Provide a high potential signal to the first thin film transistor and the third thin film transistor, and respectively reset gate and source voltages of the first thin film transistor and the third thin film transistor to a reference voltage and an initial voltage, and close the switch unit.

S101: compensation stage. Turn on the switch unit, provide a first voltage to the switch unit, and charge the source of the second thin film transistor until the second thin film transistor is turned off.

S102: data writing stage. Turn on the switch unit and write a data signal voltage to the gate of the second thin film transistor.

S103: light-emitting stage. Turn on the switch unit, and the second thin film transistor is turned on, and drives the light-emitting diode to emit light.

In the above driving method, the circuit diagram of the pixel structure in FIG. 2 is described as an example, the pixel structure circuit in FIG. 2 is a pixel structure circuit with 100% full light emission.

Figure 4:
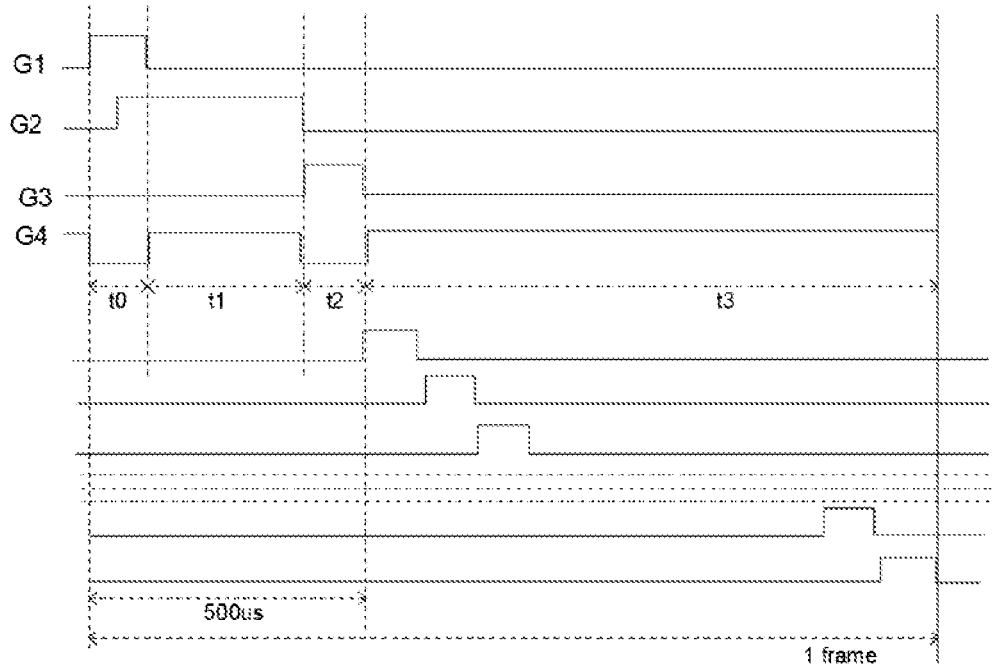
FIG. 4 is a timing diagram of a pixel circuit corresponding to FIG. 2 in the embodiment of the present disclosure.

Meanwhile, combined with FIG. 4, FIG. 4 is a timing diagram of a pixel circuit corresponding to FIG. 2 in the embodiment of the present disclosure. During driving, the initial stage of the driving circuit is a first stage, that is, correspond a time period t0 in FIG. 4, the gate control signal line G1 and the gate control signal line G2 provide high potentials, and simultaneously turn on the corresponding first thin film transistor T1 and third thin film transistor T3. Moreover, respectively reset the gate and source of the second thin film transistor T2 to the reference voltage Vref and the initial signal voltage Vini. In this process, the switch unit 100 is turned off, and the corresponding fifth thin film transistor is turned off through the gate signal control line G3, and a data signal voltage Data in the data line is stored in the second capacitor C1, which provides a basis for subsequent driving.

When the initialization is completed, the pixel circuit performs the compensation stage, which corresponds to a time period t1 in FIG. 4. At this time, the switch unit 100 is turned on, and the first voltage VDD further charges the source of the second thin film transistor T2. During the charging process, a potential of the second thin film transistor T2 continues to increase until charging of the second thin film transistor T2 is turned off. Therefore, a source voltage of the second thin film transistor T2 is (Vref-Vth).

Then perform the data writing stage, which corresponds to a time period t2 in the timing diagram of FIG. 4. At this time, the switch unit 100 is turned on, the fifth thin film transistor T5 is turned on, and the data signal voltage Data is written into the gate of the second thin film transistor T2. Meanwhile, the source voltage of the second thin film transistor T2 changes, and the source voltage is Vs=(Vdata-Vref)(Cst/(Cst+Coled))+Vref-Vth. A voltage Vgs between the gate and the source of the second thin film transistor T2 is Vgs=Vdata-[(Vdata−Vref)(Cst/(Cst+Coled))+Vref-Vth]. Then, writing of data signals is achieved.

After the signals are written, the light-emitting stage is performed, which corresponds to a time period t3 in the timing diagram of FIG. 4. At this time, the switch unit 100 is turned on and the light-emitting diode emits light. During the light-emitting process, the first capacitor Cst stores a capacitance, so that the Vgs voltage of the light-emitting diode remains unchanged during a light-emitting process, so that the entire pixel circuit emits light with good consistency.

In the embodiment of the present disclosure, a global control signal Global provides control signals for G1, G2 and G3 at the same time, thereby achieving synchronous light emission of the driving circuit, reducing a difference in threshold Vth between the thin film transistors, and ensuring display consistency of the display devices.

Figure 5:
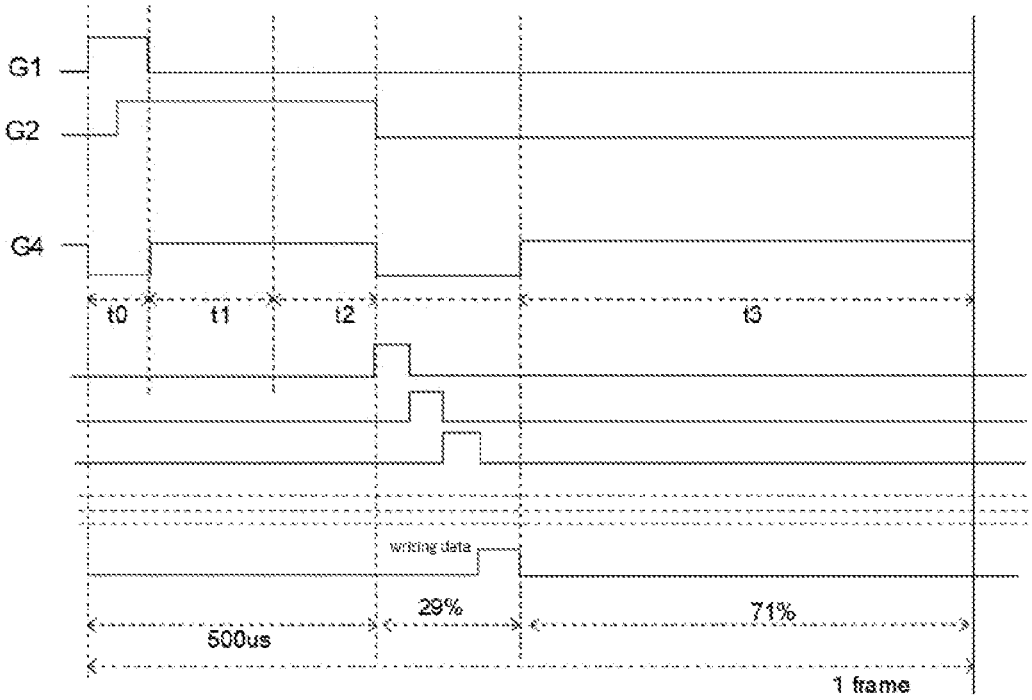
FIG. 5 is a timing diagram of a driving circuit corresponding to FIG. 1 in the embodiment of the present disclosure.

Furthermore, as shown in FIG. 5, FIG. 5 is a timing diagram of a driving circuit corresponding to FIG. 1 in the embodiment of the present disclosure. A difference from FIG. 2 and FIG. 4 is that, in the embodiment of the present disclosure, FIG. 1 and FIG. 5 are a circuit diagram and a timing diagram corresponding to 71% of a light-emitting time of the driving circuit, and FIG. 2 and FIG. 4 are a circuit diagram and a timing diagram corresponding to 100% of the light-emitting time of the driving circuit. A working principle is the same as in FIG. 4, and will not be described in detail here.

Preferably, the embodiment of the present disclosure further provides a display device, and the display device comprises the pixel structure provided by the present embodiment of the present disclosure. The display device effectively solves the problems of greater threshold voltage of each thin film transistor in the display device and poor panel display brightness consistency due to factors such as manufacturing processes during the preparation of the driving circuit of the display panel, and progressive scanning thin film transistors are reduced to one, which effectively improves the performance of the display device.

The pixel structure and the driving method thereof, and the display device provided by the embodiments of the present disclosure have been described in detail above. The present disclosure uses specific examples to describe principles and embodiments of the present disclosure. The descriptions of the above embodiments are only used to help understand technical solutions of the present disclosure and core ideas thereof. Moreover, those of ordinary skill in the art should understand that the technical solutions described in the aforesaid embodiments can still be modified, or have some technical features equivalently replaced. However, these modifications or replacements do not depart from a scope of the technical solutions of the embodiments of the present disclosure.

What is claimed is:

1. A pixel structure, wherein the pixel structure is electrically connected to a data line, a first voltage line, and a second voltage line, and the pixel structure comprises: a switch unit, wherein the switch unit comprises a control end, a first end, and a second end, and the first end of the switch unit is electrically connected to the first voltage line; a first thin film transistor, wherein a drain of the first thin film transistor is electrically connected to the second voltage line; a second thin film transistor, wherein a drain of the second thin film transistor is electrically connected to the second end, and a gate of the second thin film transistor is electrically connected to a source of the first thin film transistor; a third thin film transistor, wherein a source of the third thin film transistor is electrically connected to a source of the second thin film transistor; a first capacitor, wherein one end of the first capacitor is connected to the source of the first thin film transistor and the gate of the second thin film transistor, and the other end of the first capacitor is connected to the source of the second thin film transistor; a light-emitting diode, wherein an end of the light-emitting diode is electrically connected to the other end of the first capacitor, and the other end of the light-emitting diode is grounded; and a driving unit, wherein the driving unit comprises a control end, a first end, and a second end, the first end of the driving unit is electrically connected to the data line, and the second end of the driving unit is electrically connected to the gate of the second thin film transistor; wherein the driving unit comprises a fourth thin film transistor, the first end of the driving unit is a drain of the fourth thin film transistor, the second end of the driving unit is a source of the fourth thin film transistor, and the control end of the driving unit is a gate of the fourth thin film transistor; the control end of the driving unit is electrically connected to a scanning signal line to receive a scanning signal, and the control end of the switch unit, a gate of the first thin film transistor, and a gate of the third thin film transistor are connected to corresponding gate signal lines for realizing simultaneous control and synchronized light emitting within a frame of time; and a fifth thin film transistor, wherein a drain of the fifth thin film transistor is connected to the second end of the driving unit, and a source of the fifth thin film transistor is electrically connected to the source of the first thin film transistor, the gate of the second thin film transistor, and the end of the first capacitor, wherein the switch unit comprises a thin film transistor, the first end of the switch unit is a drain of the thin film transistor, the second end of the switch unit is a source of the thin film transistor, and the control end of the switch unit is a gate of the thin film transistor, wherein the pixel structure comprises a global input signal, and the global input signal provides a control signal for the control end of the switch unit, the gate of the first thin film transistor, and the gate of the third thin film transistor.

2. The pixel structure as claimed in claim 1, wherein the pixel structure comprises:

a second capacitor; and one end of the second capacitor is electrically connected to the second end of the driving unit, and the other end of the second capacitor is grounded.

3. The pixel structure as claimed in claim 2, wherein a capacitance of the first capacitor is equal to a capacitance of the second capacitor, and the second capacitor is configured to store a data signal written by the driving unit.

4. The pixel structure as claimed in claim 1, wherein a gate of the fifth thin film transistor is connected to a corresponding gate signal line.

5. The pixel structure as claimed in claim 1, wherein the thin film transistor of the switch unit is a true color thin film transistor.

6. A pixel structure, wherein the pixel structure is electrically connected to a data line, a first voltage line, and a second voltage line, and the pixel structure comprises: a switch unit, wherein the switch unit comprises a control end, a first end, and a second end, and the first end of the switch unit is electrically connected to the first voltage line; a first thin film transistor, wherein a drain of the first thin film transistor is electrically connected to the second voltage line; a second thin film transistor, wherein a drain of the second thin film transistor is electrically connected to the second end, and a gate of the second thin film transistor is electrically connected to a source of the first thin film transistor; a third thin film transistor, wherein a source of the third thin film transistor is electrically connected to a source of the second thin film transistor; a first capacitor, wherein one end of the first capacitor is connected to the source of the first thin film transistor and the gate of the second thin film transistor, and the other end of the first capacitor is connected to the source of the second thin film transistor; a light-emitting diode, wherein an end of the light-emitting diode is electrically connected to the other end of the first capacitor, and the other end of the light-emitting diode is grounded; and a driving unit, wherein the driving unit comprises a control end, a first end, and a second end, the first end of the driving unit is electrically connected to the data line, and the second end of the driving unit is electrically connected to the gate of the second thin film transistor; wherein the control end of the driving unit is electrically connected to a scanning signal line to receive a scanning signal, the control end of the switch unit, a gate of the first thin film transistor, and a gate of the third thin film transistor are connected to corresponding gate signal lines for realizing simultaneous control and synchronized light emitting within a frame of time, wherein the driving unit comprises a fourth thin film transistor, the first end of the driving unit is a drain of the fourth thin film transistor, the second end of the driving unit is a source of the fourth thin film transistor, and the control end of the driving unit is a gate of the fourth thin film transistor, wherein the switch unit comprises a thin film transistor, the first end of the switch unit is a drain of the thin film transistor, the second end of the switch unit is a source of the thin film transistor, and the control end of the switch unit is a gate of the thin film transistor, wherein the pixel structure comprises a global input signal, the global input signal provides a control signal for the control end of the switch unit, the gate of the first thin film transistor, and the gate of the third thin film transistor.

7. The pixel structure as claimed in claim 6, wherein the pixel structure comprises a second capacitor and a fifth thin film transistor;

one end of the second capacitor is electrically connected to the second end of the driving unit, and the other end of the second capacitor is grounded; and a drain of the fifth thin film transistor is connected to the second end of the driving unit, and a source of the fifth thin film transistor is electrically connected to the source of the first thin film transistor, the gate of the second thin film transistor, and the end of the first capacitor.

8. The pixel structure as claimed in claim 7, wherein a gate of the fifth thin film transistor is connected to a corresponding gate signal line.

9. The pixel structure as claimed in claim 7, wherein a capacitance of the first capacitor is equal to a capacitance of the second capacitor, and the second capacitor is configured to store a data signal written by the driving unit.

10. The pixel structure as claimed in claim 6, wherein the thin film transistor of the switch unit is a true color thin film transistor.

11. A display device, wherein the display device comprises a pixel structure, the pixel structure is electrically connected to a data line, a first voltage line, and a second voltage line, and the pixel structure comprises: a switch unit, wherein the switch unit comprises a control end, a first end, and a second end, and the first end of the switch unit is electrically connected to the first voltage line; a first thin film transistor, wherein a drain of the first thin film transistor is electrically connected to the second voltage line; a second thin film transistor, wherein a drain of the second thin film transistor is electrically connected to the second end, and a gate of the second thin film transistor is electrically connected to a source of the first thin film transistor; a third thin film transistor, wherein a source of the third thin film transistor is electrically connected to a source of the second thin film transistor; a first capacitor, wherein one end of the first capacitor is connected to the source of the first thin film transistor and the gate of the second thin film transistor, and the other end of the first capacitor is connected to the source of the second thin film transistor; a light-emitting diode, wherein an end of the light-emitting diode is electrically connected to the other end of the first capacitor, and the other end of the light-emitting diode is grounded; and a driving unit, wherein the driving unit comprises a control end, a first end, and a second end, the first end of the driving unit is electrically connected to the data line, and the second end of the driving unit is electrically connected to the gate of the second thin film transistor; wherein the control end of the driving unit is electrically connected to a scanning signal line to receive a scanning signal, and the control end of the switch unit, a gate of the first thin film transistor, and a gate of the third thin film transistor are connected to corresponding gate signal lines for realizing simultaneous control and synchronized light emitting within a frame of time, wherein the driving unit comprises a fourth thin film transistor, the first end of the driving unit is a drain of the fourth thin film transistor, the second end of the driving unit is a source of the fourth thin film transistor, and the control end of the driving unit is a gate of the fourth thin film transistor, wherein the switch unit comprises a thin film transistor, the first end of the switch unit is a drain of the thin film transistor, the second end of the switch unit is a source of the thin film transistor, and the control end of the switch unit is a gate of the thin film transistor, wherein the pixel structure comprises a global input signal, the global input signal provides a control signal for the control end of the switch unit, the gate of the first thin film transistor, and the gate of the third thin film transistor.

12. The display device as claimed in claim 11, wherein the pixel structure comprises a second capacitor and a fifth thin film transistor;

one end of the second capacitor is electrically connected to the second end of the driving unit, and the other end of the second capacitor is grounded; and a drain of the fifth thin film transistor is connected to the second end of the driving unit, and a source of the fifth thin film transistor is electrically connected to the source of the first thin film transistor, the gate of the second thin film transistor, and the end of the first capacitor.

13. The display device as claimed in claim 12, wherein a capacitance of the first capacitor is equal to a capacitance of the second capacitor, and the second capacitor is configured to store a data signal written by the driving unit.

* * * * *